US006866903B2

(12) United States Patent
Romano, Jr. et al.

(10) Patent No.: US 6,866,903 B2
(45) Date of Patent: Mar. 15, 2005

(54) INK JET RECORDING ELEMENT

(75) Inventors: Charles E. Romano, Jr., Rochester, NY (US); Lori J. Shaw-Klein, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/316,329

(22) Filed: Dec. 11, 2002

(65) Prior Publication Data

US 2004/0114021 A1 Jun. 17, 2004

(51) Int. Cl.[7] ..... B41M 5/40
(52) U.S. Cl. ..... 428/32.28; 428/32.25; 428/32.27; 428/32.29; 428/32.34
(58) Field of Search ..... 428/32.25, 32.27, 428/32.28, 32.29, 32.34

(56) References Cited

U.S. PATENT DOCUMENTS

2003/0148046 A1 * 8/2003 Romano et al. ..... 428/32.1
2003/0157277 A1 * 8/2003 Romano et al. ..... 428/32.1

FOREIGN PATENT DOCUMENTS

EP 1 228 890 A2 8/2002 ..... B41M/5/00

* cited by examiner

*Primary Examiner*—B. Shewareged
(74) *Attorney, Agent, or Firm*—Harold E. Cole; Chris P. Konkol

(57) ABSTRACT

An ink recording element having a support having thereon a hydrophilic absorbing layer, an inner layer of a poly(vinyl alcohol-ethylene oxide) copolymer, and a polymeric overcoat layer of a cellulose ether.

16 Claims, No Drawings

INK JET RECORDING ELEMENT

FIELD OF THE INVENTION

The present invention relates to an ink image-recording element.

BACKGROUND OF THE INVENTION

In a typical ink jet recording or printing system, ink droplets are ejected from a nozzle at high speeds towards a recording element or medium to produce an image on the medium.

The recording elements typically comprise a support or a support material having on at least one surface thereof an ink-receiving or image-forming layer.

In order to achieve and maintain high quality images on such an image-recording element, the recording element must:

Exhibit no banding, bleed, coalescence, or cracking in inked areas.

Exhibit the ability to absorb large amounts of ink and dry quickly to avoid blocking.

Exhibit high optical densities in the printed areas.

Exhibit freedom from differential gloss.

Have high levels of image fastness to avoid fade from contact with water or radiation by daylight, tungsten light, or fluorescent light.

While a wide variety of different types of image-recording elements for use with ink devices have been proposed heretofore, there are many unsolved problems in the art and many deficiencies in the known products that have severely limited their commercial usefulness. A major challenge in the design of an image-recording element is laminate adhesion. A typical coating from the prior art comprises a layer containing hydroxypropylmethyl cellulose, hydroxyethyl cellulose and a vinyl latex polymer, a layer of pectin, a layer of poly(vinyl alcohol) and polyurethane, and a layer of lime processed osseine gelatin in the order recited. However, this formulation has demonstrated coalescence, which is caused by ink puddling on the surface of the print.

EP 1 228 890 relates to an ink jet recording element which has an ink-receiving layer of a poly(vinyl alcohol-ethylene oxide) copolymer. However, there is a problem with this element in that it is not resistant to coalescence as one would like.

It is an object of this invention to provide an ink recording element which has excellent image quality and resistance to coalescence.

SUMMARY OF THE INVENTION

These and other objects are achieved in accordance with the invention which comprises an ink recording element comprising a support having thereon a hydrophilic absorbing layer, an inner layer comprising a poly(vinyl alcohol-ethylene oxide) copolymer, and a polymeric overcoat layer comprising a cellulose ether.

Another embodiment of the invention relates to an ink jet printing process comprising the steps of:

A) providing an ink jet printer that is responsive to digital data signals;

B) loading the printer with the ink jet recording element described above;

C) loading the printer with an ink jet ink composition; and

D) printing on the ink jet recording element using the ink jet ink in response to the digital data signals.

DETAILED DESCRIPTION OF THE INVENTION

The hydrophilic absorbing layer used in the invention may comprise poly(vinyl alcohol), gelatin or modified gelatin where the amino group is inactivated (such as acetylated gelatin, phthaloylated gelatin, malenoylated gelatin, benzoylated gelatin, succinylated gelatin, methyl urea gelatin, phenylcarbamoylated gelatin, and carboxy modified gelatin) and the gelatin has a bloom strength of between 100 grams and 350 grams. The absorbent gelatin may also comprise a blend of modified and non-modified gelatin. This layer may contain other hydrophilic materials such as naturally-occurring hydrophilic colloids and gums such as albumin, guar, xantham, acacia, chitosan, starches and their derivatives, functionalized proteins, functionalized gums and starches, and cellulose ethers and their derivatives, polyvinyloxazoline, such as poly(2-ethyl-2-oxazoline) (PEOX), polyvinylmethyloxazoline, polyoxides, polyethers, poly(ethylene imine), poly(acrylic acid), poly(methacrylic acid), n-vinyl amides including polyacrylamide and polyvinylpyrrolidinone (PVP), and poly(vinyl alcohol) derivatives and copolymers, such as poly(vinyl alcohol-ethylene oxide) copolymer and inorganic oxides such as silica or alumina. In a preferred embodiment of the invention, the hydrophilic absorbing layer comprises gelatin, modified gelatin, poly (vinyl alcohol), poly(vinyl pyrrolidone), poly(2-ethyl-2-oxazoline) or poly(ethylene oxide).

The hydrophilic absorbing layer may also contain a polymeric mordant such as a polymeric quaternary ammonium compound, or a basic polymer, such as poly(N,N-dimethylaminoethyl methacrylate), polyalkylenepolyamines, and products of the condensation thereof with dicyanodiamide, amine-epichlorohydrin polycondensates, lecithin and phospholipid compounds. Examples of such mordants include poly(vinylbenzyldimethylcyclohexylammonium chloride-co-styrene-co-divinylbenzene), poly (vinylbenzyltrimethylammonium chloride-co-ethylene glycol dimethacrylate), poly(vinylbenzyltrimethylammonium chloride-co-divinylbenzene), poly(N-vinylbenzyl-N-benzyl-N,N-dimethylammonium chloride-co-styrene-co-divinylbenzene), poly(diallyldimethylammonium chloride), poly([2-(methacryloyloxy)ethyl]trimethylammonium methylsulfate), poly([3-(methacryloyloxy)propyl] trimethylammonium chloride), a copolymer of vinylpyrrolidinone and 1-vinyl-3-methylimidazolium chloride, and hydroxyethyl cellulose derivitized with 1-chloro-3-(N,N,N-trimethylammonium)propane.

In a preferred embodiment of the invention, the hydrophilic absorbing layer composition is a mixture of pigskin gelatin and poly(vinylbenzyltrimethylammonium chloride-co-divinylbenzene) mordant or poly(N-vinylbenzyl-N-benzyl-N,N-dimethylammonium chloride-co-styrene-co-divinylbenzene) 49:49:2 mordant in a weight ratio of about 80:20 to about 95:5 polymer to mordant. In general, the preferred dry layer thickness of the hydrophilic absorbing layer is from about 5 $\mu$m to about 60 $\mu$m.

In another preferred embodiment of the invention, the poly(vinyl alcohol-ethylene oxide) copolymer has the following structure:

$$(CH_2CHOH)_x(OCH_2CH2)_y$$

wherein x is from about 1000 to about 8000, and y is from about 10 to about 500.

Examples of poly(vinyl alcohol-ethylene oxide) copolymers which may be used in the invention include the following:

WO-320®, AX-300® and AX-2000® (Nippon Gohsei);

Kolliocoat IT® (BASF Corp.), and

Aloctex 864® (Harco Chemical Co.).

The inner layer may also contain a polymeric mordant such as those described above for the hydrophilic absorbing layer.

The inner layer may also contain other hydrophilic materials such as naturally-occurring hydrophilic colloids and gums such as albumin, guar, xantham, acacia, chitosan, starches and their derivatives, functionalized proteins, functionalized gums and starches, and cellulose ethers and their derivatives, polyvinyloxazoline, such as poly(2-ethyl-2-oxazoline), non-modified osseine or bone or pigskin gelatins, polyvinylmethyloxazoline, polyoxides, polyethers, poly(ethylene imine), n-vinyl amides including polyacrylamide and polyvinylpyrrolidinone (PVP), and poly(vinyl alcohol) derivatives and copolymers, polyurethanes, and latices, such as polyesters and polyacrylates.

In a preferred embodiment of the invention, the inner layer comprises a mixture of a poly(vinyl alcohol-ethylene oxide) copolymer and poly(vinylbenzyltrimethylammonium chloride-co-divinylbenzene) mordant or poly(N-vinylbenzyl-N-benzyl-N,N-dimethylammonium chloride-co-styrene-co-divinylbenzene) 49:49:2 mordant in a weight ratio of about 75:25 polymer to about 95:5 polymer to mordant. In general, the dry layer thickness of the inner layer is from about 0.5 to about 5 $\mu$m.

As noted above, the polymeric overcoat layer comprises a cellulose ether. Examples of such cellulose ethers include methyl cellulose (MC), ethyl cellulose, hydroxypropyl cellulose (HPC), sodium carboxymethyl cellulose (CMC), calcium carboxymethyl cellulose, methylethyl cellulose, methylhydroxyethyl cellulose, hydroxypropylmethyl cellulose (HPMC), hydroxybutylmethyl cellulose, ethylhydroxyethyl cellulose, sodium carboxymethyl-hydroxyethyl cellulose, and carboxymethylethyl cellulose; and cellulose ether esters such as hydroxypropylmethyl cellulose phthalate, hydroxypropylmethyl cellulose acetate succinate, hydroxypropyl cellulose acetate, esters of hydroxyethyl cellulose and diallyldimethyl ammonium chloride, esters of hydroxyethyl cellulose and 2-hydroxypropyltrimethyl-ammonium chloride, and hydroxyethyl cellulose reacted with a dodecyl dimethylammonium chloride substituted epoxide (Quatrisoft LM-200® (Amerchol Corp.); as well as hydroxyethyl cellulose grafted with alkyl $C_{12}$–$C_{14}$ chains. In a preferred embodiment of the invention, the cellulose ether comprises methyl cellulose, hydroxyethyl cellulose or a cationically modified cellulose ether.

The overcoat may also contain polymeric beads, polyurethane dispersions, modified poly(vinyl alcohol) (PVA) such as PVA modified with an acetoacetoxy group or polymeric latices such as polyesters and acrylates.

In another preferred embodiment of the invention, the polymeric overcoat layer comprises a mixture of A4M® (Dow Chemical Corp.) methyl cellulose, A4® (Dow Chemical Corp.) methyl cellulose, Quatrisoft® LM200, poly (methyl methacrylate) beads and poly(N-vinylbenzyl-N-benzyl-N,N-dimethylammonium chloride-co-styrene-co-divinylbenzene) 49:49:2. The preferred dry coverage of the overcoat layer is from about 0.5 to 5 $\mu$m.

Matte particles may be added to any or all of the layers described above in order to provide enhanced printer transport, resistance to ink offset, or to change the appearance of the ink receiving layer to satin or matte finish. In addition, surfactants, defoamers, or other coatability-enhancing materials may be added as required by the coating technique chosen.

Any support or substrate may be used in the recording element of the invention. The support for the ink recording element used in the invention can be any of those usually used for ink jet receivers, such as resin-coated paper, paper, polyesters, or microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Opaque supports include plain or calendered paper, coated paper, paper coated with protective polyolefin layers, synthetic paper, photographic paper support, melt-extrusion-coated paper, and laminated paper, such as biaxially oriented support laminates. Biaxially oriented support laminates are described in U.S. Pat. Nos. 5,853,965; 5,866,282; 5,874,205; 5,888,643; 5,888,681; 5,888,683; and 5,888,714, the disclosures of which are hereby incorporated by reference. These biaxially oriented supports include a paper base and a biaxially oriented polyolefin sheet, typically polypropylene, laminated to one or both sides of the paper base. Transparent supports include glass, cellulose derivatives, e.g., a cellulose ester, cellulose triacetate, cellulose diacetate, cellulose acetate propionate, cellulose acetate butyrate; polyesters, such as poly(ethylene terephthalate), poly(ethylene naphthalate), poly(1,4-cyclohexanedimethylene terephthalate), poly(butylene terephthalate), and copolymers thereof; polyimides; polyamides; polycarbonates; poly(vinyl chloride); polystyrene; polyolefins, such as polyethylene or polypropylene; polysulfones; polyacrylates; polyetherimides; and mixtures thereof. The papers listed above include a broad range of papers, from high end papers, such as photographic paper to low end papers, such as newsprint. In particular, polyethylene-coated paper or poly(ethylene terephthalate) are preferred and are commonly used in imaging applications.

The support is suitably of a thickness of from 50 to 500 $\mu$m, preferably from 75 to 300 $\mu$m to provide acceptable look and feel as well as effectiveness in the present invention. Antioxidants, antistatic agents, plasticizers, dyes, pigments and other known additives may be incorporated into the support, if desired.

In another embodiment of the invention, a filled layer containing light scattering particles such as titania may be situated between a clear support material and the ink receptive layers described herein. Such a combination may be effectively used as a backlit material for signage applications. Yet another embodiment which yields an ink receiver with appropriate properties for backlit display applications results from selection of a partially voided or filled poly (ethylene terephthalate) film as a support material, in which the voids or fillers in the support material supply sufficient light scattering to diffuse light sources situated behind the image.

In order to improve the adhesion of the image-recording layer to the support, the surface of the support may be subjected to a corona-discharge treatment prior to applying the image-recording layer. The adhesion of the image-receiving layer to the support may also be improved by coating a subbing layer on the support. Examples of materials useful in a subbing layer include halogenated phenols and partially hydrolyzed vinyl chloride-co-vinyl acetate polymer. In order to impart mechanical durability to an ink recording element, crosslinkers which act upon the binder discussed above may be added in small quantities. Such an additive improves the cohesive strength of the layer. Crosslinkers such as carbodiimides, polyfunctional aziridines, aldehydes, isocyanates, epoxides, polyvalent metal cations, and the like may all be used.

To improve colorant fade, UV absorbers, radical quenchers or antioxidants may also be added to the image receiving layer as is well known in the art. Other additives include pH modifiers, adhesion promoters, rheology modifiers, surfactants, biocides, lubricants, dyes, optical brighteners, matte agents, antistatic agents, etc. In order to obtain adequate coatability, additives known to those familiar with such art such as surfactants, defoamers, alcohol and the like may be used. A common level for coating aids is 0.01 to 0.30 wt. % active coating aid based on the total solution weight. These coating aids can be nonionic, anionic, cationic or amphoteric. Specific examples are described in MCCUTCHEON's Volume 1: Emulsifiers and Detergents, 1995, North American Edition.

Optionally, an additional backing layer or coating may be applied to the backside of a support (i.e., the side of the support opposite the side on which the image-recording layers are coated) for the purposes of improving the machine-handling properties and curl of the recording element, controlling the friction and resistivity thereof, and the like.

Typically, the backing layer may comprise a binder and a filler. Typical fillers include amorphous and crystalline silicas, poly(methyl methacrylate), hollow sphere polystyrene beads, micro-crystalline cellulose, zinc oxide, talc, and the like. The filler loaded in the backing layer is generally less than 5 percent by weight of the binder component and the average particle size of the filler material is in the range of 5 to 30 $\mu$m. Typical binders used in the backing layer are polymers such as polyacrylates, gelatin, polymethacrylates, polystyrenes, polyacrylamides, vinyl chloride-vinyl acetate copolymers, poly(vinyl alcohol), cellulose derivatives, and the like. Additionally, an antistatic agent also can be included in the backing layer to prevent static hindrance of the recording element. Particularly suitable antistatic agents are compounds such as dodecylbenzenesulfonic acid sodium salt, octylsulfonic acid potassium salt, oligostyrenesulfonic acid sodium salt, laurylsulfosuccinic acid sodium salt, and the like. The antistatic agent may be added to the binder composition in an amount of 0.1 to 15 percent by weight, based on the weight of the binder. An image-recording layer may also be coated on the backside, if desired.

While not necessary, the hydrophilic material layers described above may also include a crosslinker. Such an additive can improve the adhesion of the ink receptive layer to the substrate as well as contribute to the cohesive strength and water resistance of the layer. Crosslinkers such as carbodiimides, polyfunctional aziridines, melamine formaldehydes, isocyanates, epoxides, and the like may be used. If a crosslinker is added, care must be taken that excessive amounts are not used as this will decrease the swellability of the layer, reducing the drying rate of the printed areas.

Coating compositions employed in the invention may be applied by any number of well known techniques, including dip-coating, wound-wire rod coating, doctor blade coating, gravure and reverse-roll coating, slide coating, bead coating, extrusion coating, curtain coating and the like. Known coating and drying methods are described in further detail in Research Disclosure no. 308119, published Dec. 1989, pages 1007 to 1008. Slide coating, in which the base layers and overcoat may be simultaneously applied is preferred as cost effective as well as useful in the present invention. After coating, the layers are generally dried by simple evaporation, which may be accelerated by known techniques such as convection heating.

Inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following example is provided to illustrate the invention.

EXAMPLE

Element 1

A polyethylene resin-coated paper was treated by corona discharge and coated by means of a coating hopper with a mixture of 10% gelatin solution in water (pig skin gelatin, Nitta Gelatine Company), and 0.6% 12 $\mu$m polystyrene beads, at a dry thickness of about 11 $\mu$m, and an inner layer consisting of a 5% solution of WO-320 poly(vinyl alcohol-ethylene oxide) co-polymer (Nippon Gohsei), at a dry thickness of about 2 $\mu$m and an overcoat layer consisting of a mixture of methyl cellulose (Methocel® A4M and A4C, Dow Chemical Corp.), hydroxyethyl cellulose reacted with a dodecyl dimethylammonium chloride substituted epoxide (Quatrisoft LM-200®, Amerchol Corp.), poly(methylmethacrylate) beads (Eastman Kodak Co.), poly(N-vinylbenzyl-N-benzyl-N,N-dimethylammonium chloride-co-styrene-co-divinylbenzene) 49:49:2 (Eastman Kodak Company), Surfactant 10G (Arch Chemical) and Zonyl FS300® surfactant (DuPont Corp.) in a ratio by weight of 28.2/28.2/28.2/9.4/3/3, at a dry thickness of about 1 $\mu$m. The coatings were dried thoroughly by forced air heat after application of the coating solutions.

Element 2

This element was prepared the same as Element 1 except that the inner layer consisted of WO-320, poly(vinyl alcohol-ethylene oxide) copolymer (Nippon Gohsei) and a poly(vinylbenzyltrimethylammonium chloride-co-divinylbenzene mordant, where the WO-320 and mordant were mixed in a 90:10 ratio by weight.

Control Element C-1 (No Poly(Vinyl Alcohol-Ethylene Oxide) Copolymer)

This element was prepared the same as Element 1 except that WO-320 was replaced with K-210 cationic poly(vinyl alcohol) (Nippon Gohsei).

Control Element C-2 (No Poly(Vinyl Alcohol-Ethylene Oxide) Copolymer)

This element was prepared the same as Element 1 except that WO-320 was replaced with PVP K-90 (ISP Technologies).

Control Element C-3 (No Poly(Vinyl Alcohol-Ethylene Oxide) Copolymer)

This element was prepared the same as Element 1 except that WO-320 was replaced with HEC QP300 hydroxyethyl cellulose (Dow Chemical Co).

Control Element C-4 (No Poly(Vinyl Alcohol-Ethylene Oxide) Copolymer)

This element was prepared the same as Element 1 except that WO-320 was replaced with PEO N-80 poly(ethylene oxide) (Dow Chemical Co.).

Control Element C-5 (No Poly(Vinyl Alcohol-Ethylene Oxide) Copolymer)

This element was prepared the same as Element 1 except that WO-320 replaced with AH-17 poly(vinyl alcohol) (Nippon Gohsei).

Control Element C-6 (No Poly(Vinyl Alcohol-Ethylene Oxide) Copolymer)

This element was prepared the same as Element 1 except that WO-320 replaced with Z-320 acetoacetylated poly (vinyl alcohol) (Nippon Gohsei).

Control Element C-7 (No Poly(Vinyl Alcohol-Ethylene Oxide) Copolymer)

This element was prepared the same as Element 1 except that WO-320 replaced with T-215 carboxylated poly(vinyl alcohol) (Nippon Gohsei).

Control Element C-8 (No Poly(Vinyl Alcohol-Ethylene Oxide) Copolymer)

This element was prepared the same as Element 1 except that WO-320 replaced with L-0302 sulfonated poly(vinyl alcohol) (Nippon Gohsei).

Control Element C-9 (No Poly(Vinyl Alcohol-Ethylene Oxide) Copolymer)

This element was prepared the same as Element 1 except that WO-320 replaced with LT-300 CMC carboxymethyl cellulose (Penn Carbose Inc.).

Control Element C-10 (No Poly(Vinyl Alcohol-Ethylene Oxide) Copolymer)

This element was prepared the same as Element 1 except that WO-320 replaced with A4M methyl cellulose (Dow Chemical Co.).

Control Element C-11 (No Poly(Vinyl Alcohol-Ethylene Oxide) Copolymer)

This element was prepared the same as Element 1 except that WO-320 replaced with a mixture of Elvanol 52-22 poly(vinyl alcohol) (DuPont Corp.) and Witcobond® 232 polyurethane (Witco Corp.) in a 77:23 ratio by weight.

Control Element C-12 (No Poly(Vinyl Alcohol-Ethylene Oxide) Copolymer)

This element was prepared the same as Element 1 except that WO-320 replaced with NS-286 LX polyurethane dispersion. (Nagase Co.).

Control Element C-13 (No Poly(Vinyl Alcohol-Ethylene Oxide) Copolymer)

This element was prepared the same as Element 1 except that WO-320 replaced with Airvam® poly(vinyl alcohol)/poly(vinyl amine) co-polymer (Air Products Corp.).

Control Element C-14 (No Overcoat Layer)

This element was prepared the same as Element 1 except that no overcoat was used.

Control Element C-15 (No Overcoat Layer)

This element was prepared the same as Element 2 except that no overcoat was used.

Control Element C-16 (No Inner Layer)

This element was prepared the same as Element 1 except that no inner layer was used.

Testing 5 cm×10 cm cyan, magenta, yellow, and black patches were printed at ambient room conditions with an Epson 890 printer equipped with a black cartridge (C13T007311) and a color cartridge (C13T008201)

After allowing the elements to dry overnight, the color patches were visually examined for coalescence. The results of the visual examination are reported below in Table 1.

TABLE 1

| Element | Coalescence |
|---|---|
| 1 | Good |
| 2 | Good |
| C-1 | Poor |
| C-2 | Poor |
| C-3 | Poor |
| C-4 | Poor |
| C-5 | Poor |
| C-6 | Poor |
| C-7 | Poor |
| C-8 | Poor |
| C-9 | Poor |
| C-10 | Poor |
| C-11 | Poor |
| C-12 | Poor |
| C-13 | Poor |
| C-14 | Poor |
| C-15 | Poor |
| C-16 | Fair |

The above results show that the invention examples have better coalescence than the control elements.

The invention has been described in detail with particular reference to certain preferred embodiments thereof, but it will be understood that variations and modifications can be effected within the spirit and scope of the invention.

What is claimed is:

1. An ink recording element comprising a support having thereon a hydrophilic absorbing layer, an inner layer comprising a poly(vinyl alcohol-ethylene oxide) copolymer, and a polymeric overcoat layer comprising a cellulose ether, wherein said poly(vinyl alcohol-ethylene oxide) copolymer has the following structure:

$$(CH_2CHOH)_x(OCH_2CH_2)_y$$

wherein:

x is from about 1000 to about 8000, and y is from about 10 to about 500.

2. The recording element of claim 1 wherein said hydrophilic absorbing layer comprises gelatin, modified gelatin, poly(vinyl alcohol), poly(vinyl pyrrolidone), poly(2-ethyl-2-oxazoline) or poly(ethylene oxide).

3. The ink recording element of claim 1 wherein said hydrophilic absorbing layer comprises gelatin.

4. The ink recording element of claim 1 wherein said cellulose ether comprises methyl cellulose, hydroxyethyl cellulose or a cationically modified cellulose ether.

5. The ink recording element of claim 4 wherein said cationically modified cellulose ether is hydroxyethyl cellulose reacted with a dodecyl dimethylammonium chloride substituted epoxide.

6. The ink recording element of claim 1 wherein said polymeric overcoat layer contains a mordant.

7. The ink recording element of claim 6 wherein said mordant is poly(vinylbenzyltrimethylammonium chloride-co-divinylbenzene or poly(N-vinylbenzyl-N-benzyl-N,N-dimethylammonium chloride-co-styrene-co-divinylbenzene).

8. The ink recording element of claim 1 wherein said polymeric overcoat layer contains polymeric beads.

9. The ink recording element of claim 8 wherein said polymeric beads are poly(methyl methacrylate) beads.

10. The ink recording element of claim 1 wherein said inner layer contains a mordant.

11. The ink recording element of claim 10 wherein said mordant is poly(vinylbenzyltrimethylammonium chloride-co-divinylbenzene or poly(N-vinylbenzyl-N-benzyl-N,N-dimethylammonium chloride-co-styrene-co-divinylbenzene).

12. The ink recording element of claim 1 wherein said hydrophilic absorbing layer contains a mordant.

13. The ink recording element of claim 12 wherein said mordant is poly(vinylbenzyltrimethylammonium chloride-co-divinylbenzene or poly(N-vinylbenzyl-N-benzyl-N,N-dimethylammonium chloride-co-styrene-co-divinylbenzene).

14. The ink recording element of claim 1 wherein said hydrophilic absorbing layer has a dry thickness of from 5 to 60 $\mu$m.

15. The ink recording element of claim 1 wherein said polymeric overcoat layer has a dry thickness of from 0.5 to 5 $\mu$m.

16. The ink recording element of claim 1 wherein said inner layer has a dry thickness of from 0.5 to 5 $\mu$m.

* * * * *